United States Patent [19]

Briner

[11] Patent Number: 4,466,340

[45] Date of Patent: Aug. 21, 1984

[54] CHIMNEY ASSEMBLY

[75] Inventor: Clifton F. Briner, Fort Wayne, Ind.

[73] Assignee: American Standard Inc., New York, N.Y.

[21] Appl. No.: 442,548

[22] Filed: Nov. 18, 1982

[51] Int. Cl.[3] ..... F23L 17/12

[52] U.S. Cl. ..... 98/60; 98/84; 110/160; 126/120

[58] Field of Search ..... 98/58, 60, 66 R, 67, 98/78, 79, 81, 83, 84; 110/160; 126/120, 307 R, 316; 138/39

[56] References Cited

U.S. PATENT DOCUMENTS

| | | | |
|---|---|---|---|
| 199,620 | 1/1978 | Corby . | |
| 539,391 | 5/1895 | Newman . | |
| 596,286 | 12/1897 | Mickel . | |
| 615,600 | 12/1898 | Wewers . | |
| 780,378 | 1/1905 | Palladino . | |
| 1,409,324 | 3/1922 | Willett . | |
| 1,578,030 | 3/1926 | Hirschberg . | |
| 2,634,720 | 4/1953 | Thulman | 126/307 R |
| 2,722,372 | 11/1955 | Edwards | 110/160 X |
| 2,818,060 | 12/1957 | Field | 126/307 R |
| 2,856,837 | 10/1958 | Thulman | 98/46 |
| 2,916,983 | 12/1959 | Kinkead | 126/307 R X |
| 3,076,480 | 2/1963 | Vicard | 138/39 |
| 3,087,408 | 4/1963 | Carr | 98/46 |
| 3,134,345 | 5/1964 | King | 110/160 |
| 3,171,402 | 3/1965 | Carlson | 126/116 |
| 3,282,194 | 11/1966 | Thulman | 98/59 |
| 3,521,582 | 7/1970 | Liden | 110/147 |
| 3,724,499 | 4/1973 | Huhiv | 138/39 X |
| 3,872,780 | 3/1975 | Zanias | 98/60 |
| 3,874,363 | 4/1975 | Biedenbender et al. | 48/5R X |
| 4,003,362 | 1/1977 | Lener | 126/121 |
| 4,069,668 | 1/1978 | Oldberg | 98/84 X |
| 4,200,038 | 4/1980 | Briner et al. | 98/84 |

FOREIGN PATENT DOCUMENTS

| | | | |
|---|---|---|---|
| 680005 | 10/1952 | United Kingdom | 110/160 |

*Primary Examiner*—Harold Joyce

*Attorney, Agent, or Firm*—James J. Salerno, Jr.; Robert G. Crooks; John P. Sinnott

[57] ABSTRACT

A prefabricated chimney assembly of the dual-wall type, adapted to be coupled to the flue outlet of a fireplace, is disclosed. The chimney assembly includes an inner conduit extending the length of the chimney assembly to form the flue through which combustion gases flow upwardly, and an outer conduit mounted in spaced relationship to the inner conduit so as to define an annular passage for conducting only outside air downwardly therethrough. An outside-air-inducing means is connected to the open lower end of the chimney assembly and includes a convergent nozzle, the upper end of which is coupled to the lower end of the flue, and an air-turning vane mounted in spaced relationship between the lower end of the chimney assembly and the lower end of the convergent nozzle so that the lower end of the convergent nozzle is positioned within the air-turning vane but spaced therefrom, whereby outside air flowing downwardly through the annular passage is induced into the flue for mixing with the hot combustion gases substantially to cool them and any suspended particulate matter, such as creosote, whereby it remains substantially entrained within the cooled flue gases.

7 Claims, 7 Drawing Figures

12
57
58
10
14
28
20
25
33
34
57
15
29
16
30
11
56
3
3
59
57'
21
57
55
27
23
38
33
24
22
26
57

CHIMNEY ASSEMBLY

BACKGROUND OF THE INVENTION

This invention relates to a prefabricated chimney assembly of sheet metal construction and more particularly, to a dual wall chimney assembly in which only outside air is induced into the chimney flue for cooling the hot combustion gases, and further provides means for maintaining the particulate matter substantially entrained in the hot combustion gases.

Prefabricated, multi-wall chimney assemblies of sheet metal construction are known and are presently being used in dwelling constructions particularly where masonry fireplace constructions are not used. A commonly used multi-wall chimney assembly of sheet metal construction is disclosed in U.S. Pat. No. 2,634,720 which describes a thermosiphoning chimney wherein outside air is drawn down through an outer annular passage and upwardly through an inner annular passage and expelled to the outside air. The hot gases in the central flue are expelled to the atmosphere in the usual fashion. One variation of a triple wall chimney assembly is shown in U.S. Pat. No. 3,087,408, wherein air is drawn from the bottom of the chimney stack and is passed upwardly through the outer annular passages. The cooling air does not mix with the hot combustion gases in either of the above chimney designs. Another type of chimney is a dual wall chimney assembly, also of sheet metal construction, as shown in U.S. Pat. No. 2,916,983, and is a system wherein outside air is drawn in from the top through an annular passageway adjacent the flue and then conducted through an opening at its base into the flue so that the outside air rises and mixes with the hot combustion gases.

In addition, many chimney top structures are known which are adapted to be mounted on the exit end of a chimney flue of a thermosiphoning chimney such as is disclosed in U.S. Pat. Nos. 2,856,837, 3,282,194, and 4,200,038. In U.S. Pat. No. 4,200,038 a divergent nozzle mounted on the top section of the flue is used to improve the flow rate through the thermosiphoning passages of the chimney assembly and to recover the energy normally lost by the exiting flue gases. No outside air is introduced into the flue gases. In U.S. Pat. No. 615,600 two cup shaped, perforated plates, arranged complementary to each other, are mounted on a flue pipe so that ambient air is drawn through the openings in one plate and is conducted through the openings of the second plate, is inside the flue. This construction prevents the buildup of soot such as creosote. Note, however, that the openings of the plate can be closed or sealed by the user.

SUMMARY OF THE INVENTION

It is an object of the invention to provide a dual wall chimney assembly, of sheet metal construction, having novel air inducing means wherein only outside air is induced into the flue for mixing with the hot combustion gases to cool them whereby corrosion and structural stress commonly caused by hot flue gases acting on the metal flue are substantially reduced.

It is another object of the invention to provide a dual wall chimney assembly wherein the air-inducing means includes a convergent nozzle mounted at the lower end of the chimney to accelerate the flow of outside air into the chimney flue and a divergent nozzle mounted at the upper end of the chimney to decelerate the cooled combustion gases and to recover the energy normally lost by the exiting flue gases.

The invention generally contemplates providing a prefabricated chimney assembly of the dual wall type which is adapted to be coupled to the fireplace flue outlet opening. The chimney assembly includes an inner conduit extending the length of the chimney assembly to form the flue through which combustion gases flow upwardly and an outer conduit mounted in spaced relation to the inner conduit so as to define therewith an annular passage for conducting only outside air downwardly therethrough. An outside air-inducing means is coupled to the open lower end of the chimney assembly and includes an annular collar, one end of which is coupled to the lower end of the outer conduit, the other end forming a baffle that extends radially inwardly to close the annular air passage. An air-turning vane is mounted between the baffle and the lower end of the chimney assembly. The invention also includes a convergent nozzle, one end of which is connected to the lower end of the flue and the other end of which is positioned within the air-turning vane and is spaced therefrom. The outside-air-inducing means also includes a nozzle formed around the inner end of the baffle of the annular collar, the nozzle opening being proportioned to optimize the ratio of cooling air to hot combustion gas that is induced into the flue at a point above the fireplace combustion gas outlet opening but below the damper. Also, when the cool air mixes with the hot combustion gases, the particulate matter, such as creosote, remains substantially entrained within the cooled flue gases. The chimney assembly further includes a divergent nozzle, one end of which is mounted on the open upper end of the flue and the other end of which extends radially outwardly to a point above the open upper end of the outer conduit but the diameter of which is less than the diameter of outer conduit, whereby exiting flue gases are discharged to the atmosphere at a point above where the outside air enters the annular passage of the chimney assembly.

IN THE DRAWINGS

DETAILED DESCRIPTION OF THE PREFERRED EMBODIMENT

The dual wall chimney assembly 10 of the present invention is shown most clearly in full assembly in FIG.

Figure 1:
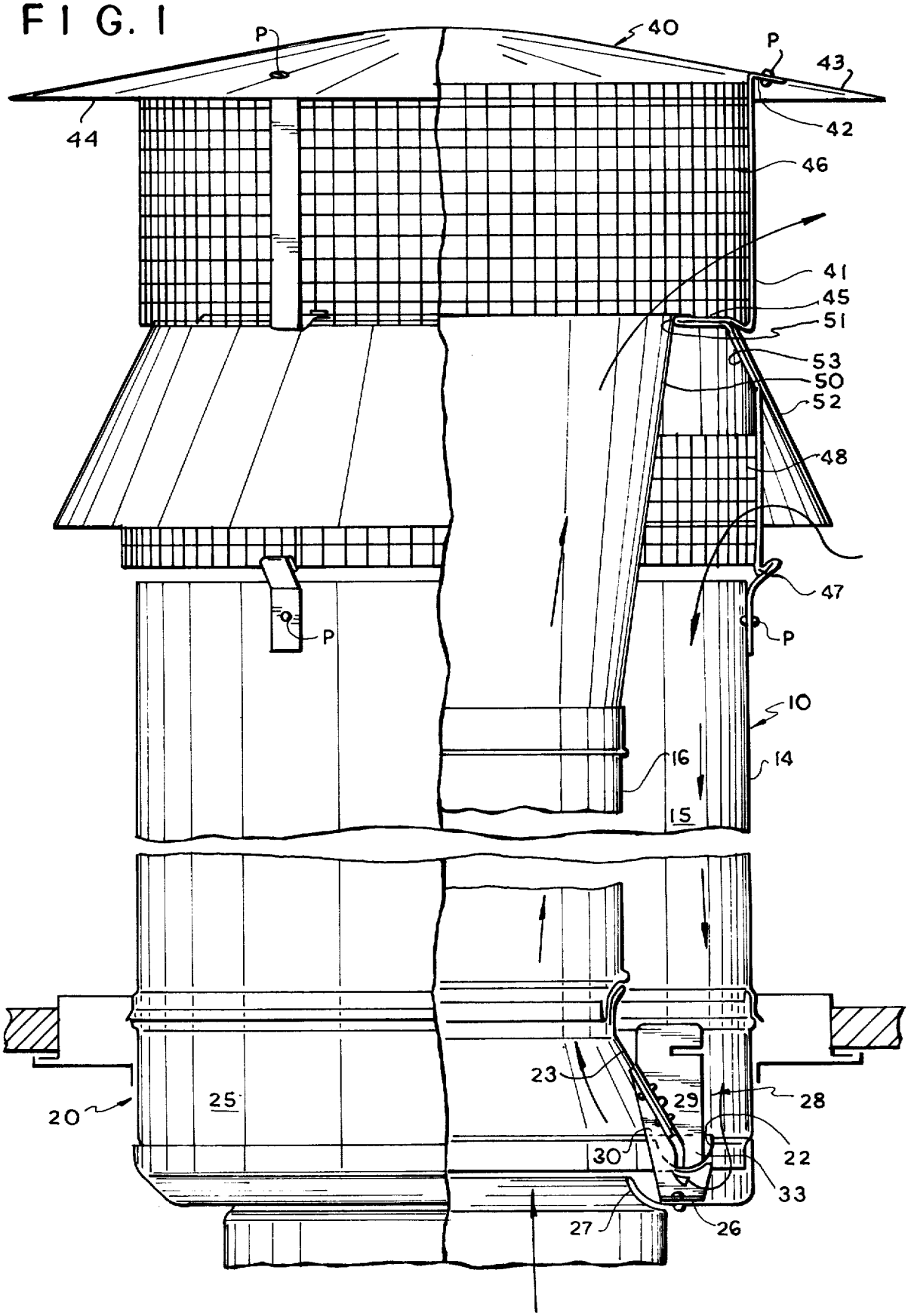
FIG. 1 is an elevational view, partially in section, of the dual wall chimney assembly of the present invention.
Figure 2:
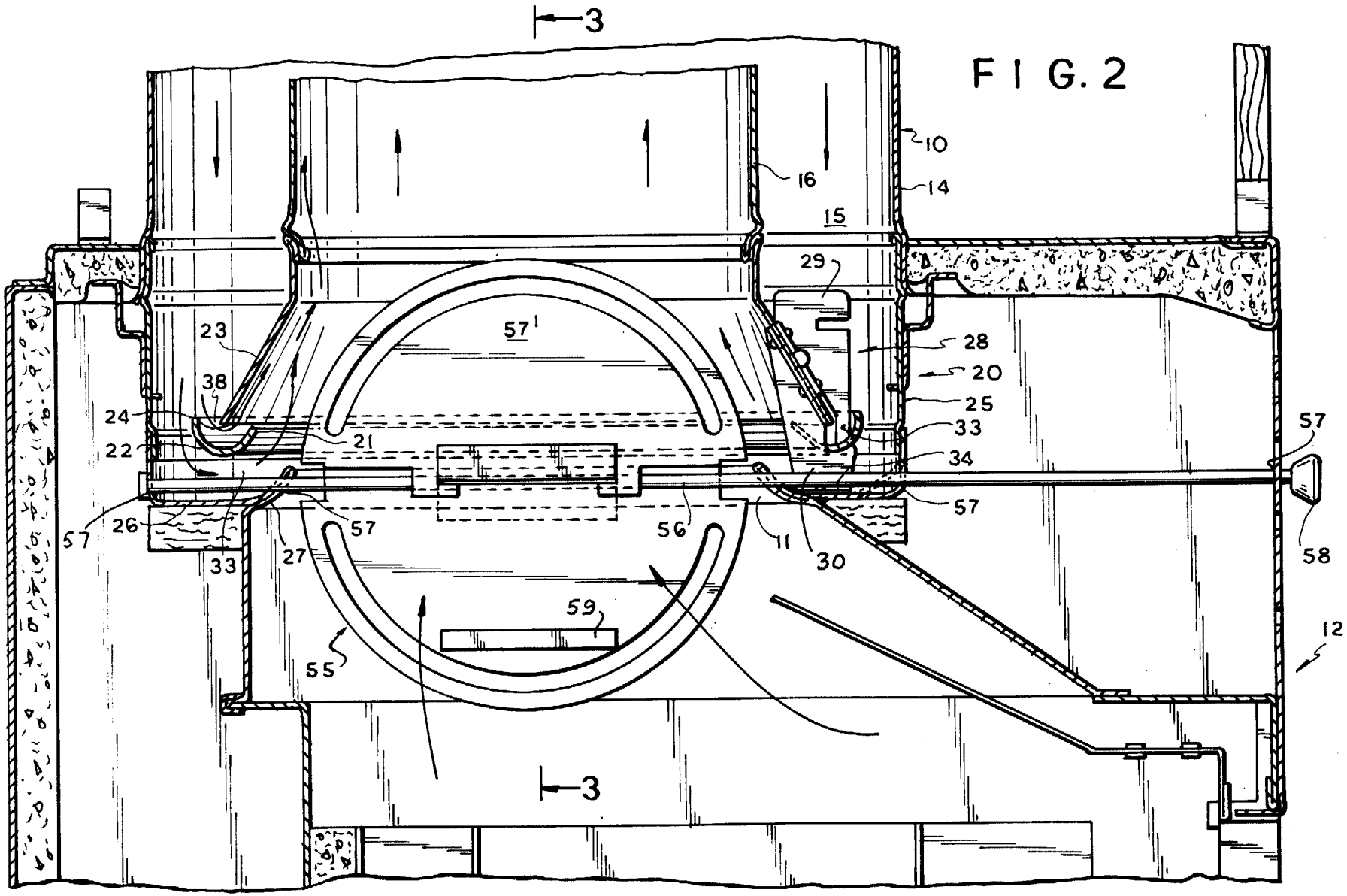
FIG. 2 is an enlarged elevational view, partially in section, of the outside air-turning assembly operatively mounted to the flue opening of a fireplace assembly, and the lower section of the chimney assembly shown in FIG. 1.

1 and is shown in its mounted position to combustion gas outlet 11 of fireplace 12 in FIG. 2. Chimney assembly 10 is of the double wall type and is preferably made of sheet metal. An outer pipe 14 is mounted in spaced apart relation with inner pipe or flue 16 to provide an annular passage 15 for the flow of outside air downwardly within the chimney assembly 10. Chimney assembly 10 also includes a chimney top assembly 40 and an outside air-turning assembly 20 which are operatively coupled, respectively, to open upper and lower ends of chimney assembly 10 as illustrated in FIG. 1. An inner pipe or flue 16 is mounted in spaced apart relation with outer pipe 14 by a plurality of circumferentially spaced brackets, not shown. The spaced brackets are conventionally mounted, respectively, to the outer surface of inner pipe 16 and the inner surface of outer pipe 14. Also, inner pipe 16 extends the length of chimney assembly 10 and is adapted to be coupled to an outlet source from which combustion gases are expelled, such as the flue outlet of a fireplace. Outside air-turning assembly 20 provides means whereby only outside air is conducted downwardly through annular passage 15 and is induced into flue 16 through a novel arrangement of nozzle means in cooperation with air-turning vane 22 as illustrated most clearly in FIGS. 2 and 4.

Air-turning vane 22 is a semi-toroidal ring with its inner perimeter rim having a frusto-conical portion 21 that extends tangentially therefrom. Air-turning vane 22 has a radius "r" of about ½ inch and a frusto-conical portion extending tangentially therefrom of about ¼ inch. A convergent nozzle 23 is mounted at its upper end to the open lower end of flue 16 and extends therefrom so that its lower end, rim 24, nests within the semi-toroidal ring of air-turning vane 22. Frusto-conical portion 21 of air-turning vane 22 is spaced from the outer rim 24 of convergent nozzle 23 but is concentric therewith so that, when air is induced into flue 16, it is projected along the inner surface of convergent nozzle 23 and into the flue as shown by the direction of the arrows in FIG. 2. Air-turning vane 22 and convergent nozzle 23 of air-turning assembly 20 are housed by annular collar 25.

The upper end of annular collar 25 is mounted to the open lower end of outer conduit 14. The lower end of annular collar 25 has a baffle 26 extending radially inwardly to close annular passage 15. Baffle 26 terminates in a section forming a nozzle 27. The cross sectional area of nozzle 27 is proportioned to optimize the ratio of outside air entering flue 16 from convergent nozzle 23, to the hot combustion gases exiting fireplace 12. The hot combustion gases passing through nozzle 27 and outside air entering convergent nozzle 23 are accelerated into flue 16 at a point above the fireplace combustion gas outlet opening 11. The upper end of nozzle 27 has a cross sectional area which is less than the effective cross sectional area of the open lower end of flue 16. When the outside air and the hot combustion gases are mixed, the flue gases are cooled down about 37% so that the particulate matter, such as creosote, remains substantially entrained within the cooled flue gases.

Figure 4:
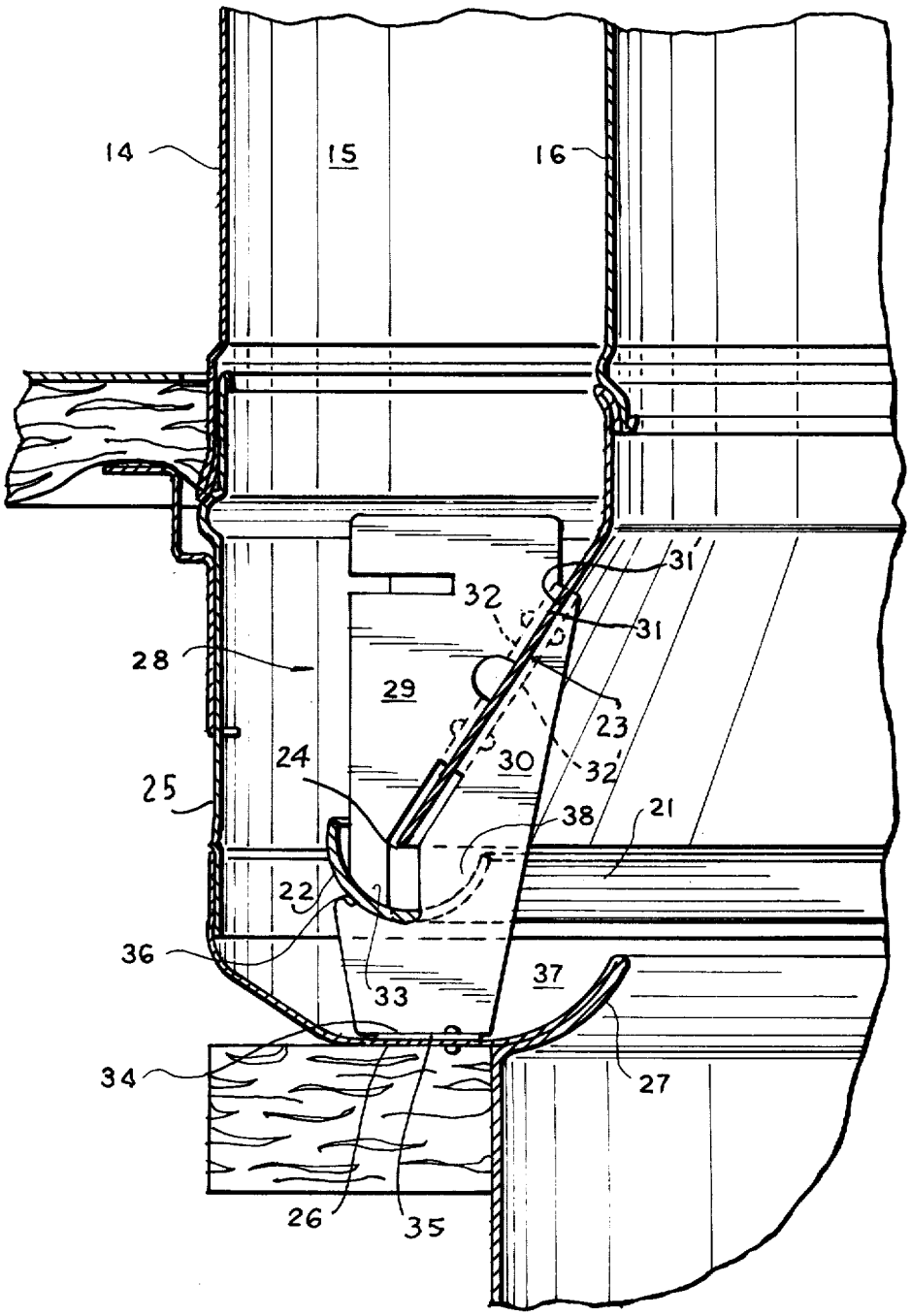
FIG. 4 is an enlarged, fragmentary sectional view of the air-turning assembly shown in FIG. 2.
Figure 6:
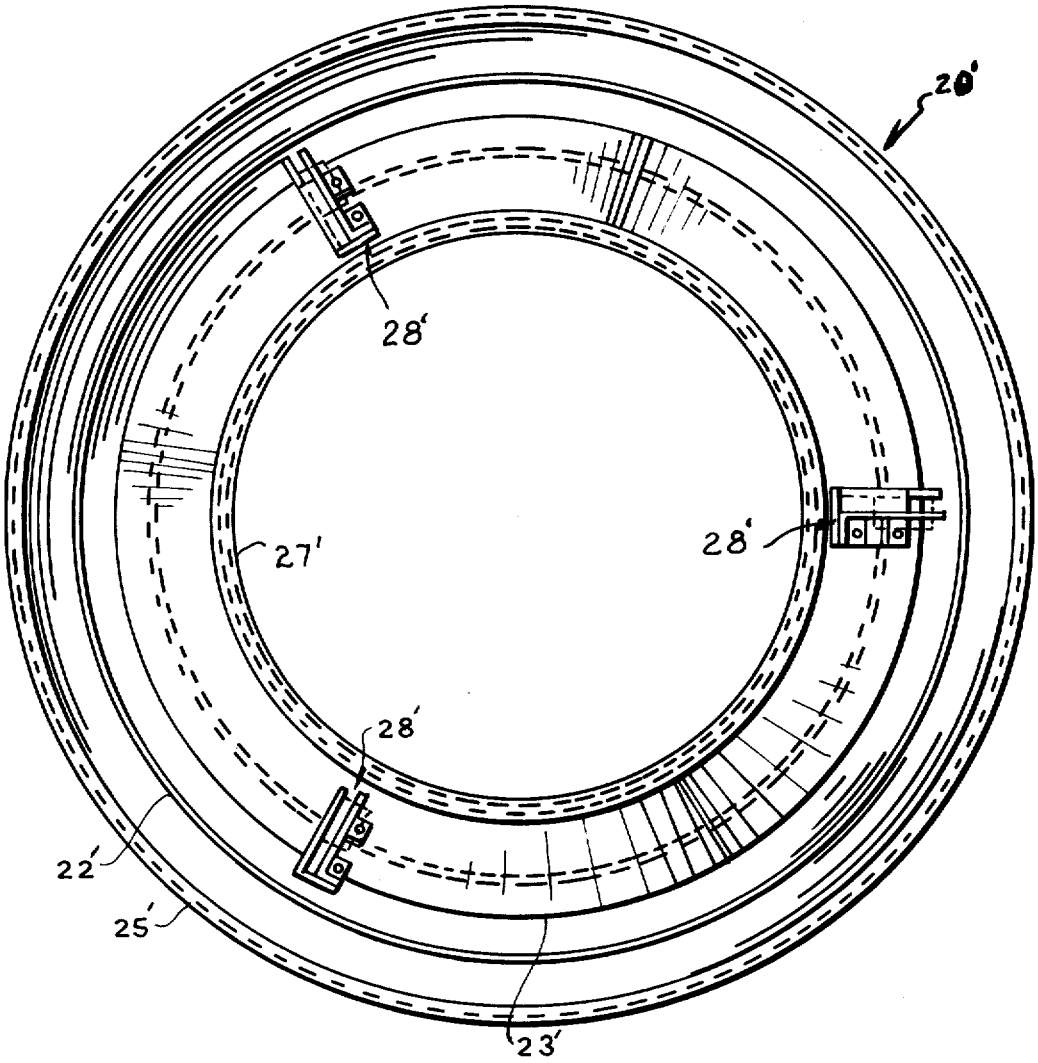
FIG. 6 is a top plan view taken along the line 6—6 of FIG. 5.
Figure 7:
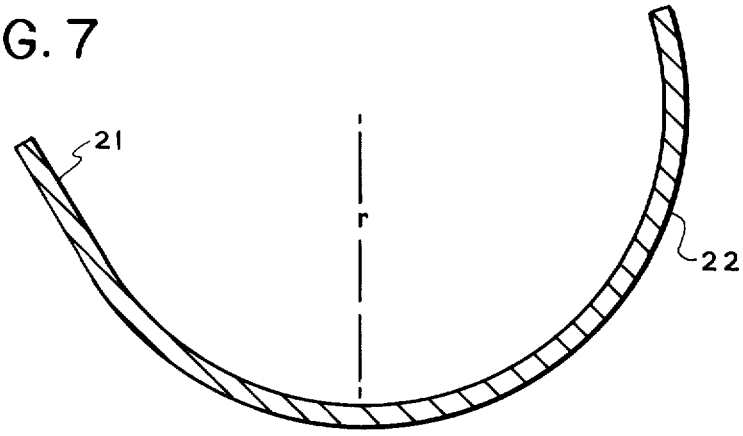
FIG. 7 is an enlarged sectional view in elevation of the air-turning vane shown in FIGS. 1 through 4.

Air-turning vane 22 is mounted within annular collar 25 and is held in spaced relation between baffle 26 and the open outer rim 24 of convergent nozzle 23 by a plurality of brackets 28 positioned around air-turning vane 22. Brackets 28, most clearly illustrated in FIG. 4, are made in two segments, an upper bracket 29 and a lower bracket 30. One side of upper bracket 29 is formed having an inclined surface 31 with at least one integral tab 32 extending laterally therefrom. A curved head 33 of upper bracket 29 is seated within air turning vane 22. Lower bracket 30 also includes inclined surface 31' and at least one laterally extending mounting tab 32' is complementarily arranged with upper bracket 29. A tab 35 is integrally formed on lower bracket 30 and extends laterally from base 34. Tab 35 is mounted on baffle 26, as by pop rivets or sheet metal screws. After lower bracket 30 has been positioned on baffle 26, air-turning vane 22 is positioned on seat 36. Then upper bracket 29 is positioned in air-turning vane 22 so that its curved head 33 seats against the inner curved surface vane 22, as illustrated in FIG. 4. Thereafter, upper and lower brackets 29, 30 are fixed in position against the inner and outer surfaces of convergent nozzle 23 as by pop rivets or sheet metal screws through their respective complementary tabs as best illustrated in FIGS. 2, 4 and 6. Rim 24 of convergent nozzle 23 is spaced from the inner surface of the semi-toroidal ring of air-turning vane 22 to define second air passage 38. Also, air-turning vane 22 is spaced from baffle 26 to define first air passage 37, as best illustrated in FIG. 4. Outside air is conducted downwardly through passage 15 until the air enters air-turning assembly 20. At this point, a major portion of the air follows the direction of the arrows through first air passage 37, with a minor portion of the air following the direction of the arrows entering convergent nozzle 23 through second air passage 38. After introduction into convergent nozzle 23, the outside air is accelerated into flue 16. Hot combustion gases, after passing damper 57' are accelerated through nozzle 27 and convergent nozzle 23 so that both the outside air and hot combustion gases enter the flue at approximately the same velocity. A major portion of the outside air is conducted through first air passage 37 and mixes with the hot combustion gases while a minor portion of outside air is conducted through second air passage 38, and cools the inner surfaces of convergent nozzle 23 and flue 16.

Chimney top assembly 40 is mounted on outer conduit 14 by a plurality of circumferentially spaced brackets 41. Each bracket 41 extends vertically upwardly and has a laterally extending tab 42 at its upper end, on which rain cap 43 is mounted, as by pop rivets "P". Rain cap 43 is in the form of a cone so that rain falling thereon drains from its base around its outer rim 44, the slope of the cone being such as to prevent water from entering the chimney flue by capillarity along its under surface. The diameter of rain cap 43 at its base extends beyond the perimeter of outer conduit 14, thereby providing rain water from entering outside air passage 15. Rain cap 43 is positioned above the upper rim 51 of divergent nozzle 50 at a distance of about 2¾ to 5½ inches, the distance being measured between the respective planes of the base of rain cap 43 and of the upper rim 51 of divergent nozzle 50. Also, the outer rim 44 of rain cap 43 terminates preferably in a tapered edge to minimize any increase in pressure drop on the exiting flue gases which would decrease the efficiency of chimney assembly 10.

A horizontal in-turned flange 45 is integrally formed between the ends of bracket 41 and seats against upper rim 51 of divergent nozzle 50 to provide support and mounting means for upper screen 46. Upper screen 46 protects chimney assembly 10 against debris, animals or birds entering the chimney flue. The lower end of bracket 41 has an outwardly flared flange 47 that provides a seat for lower screen 48 to be mounted thereon to function in a similar fashion to upper screen 46. A rain skirt 52 is mounted, as by pop rivets, on inclined surface 53 of bracket 41 to prevent rain water from entering outside air passage 15. Also, rain skirt 52 induces outside air into air passage 15 and accelerates outside air downwardly therein toward air-turning assembly 20. Air-turning assembly 20 conducts outside air through first and second air passages 37, 38, into convergent nozzle 23, where it is further accelerated before entering flue 16. The cooling air flows into the flue because of the difference in gas densities between the outside cool air passage and the interior hot flue gas column, so that the denser, colder, outside air is induced into the flue gases at the air entry zone of flue 16 and prevents outside air passage 15 from becoming a secondary chimney. Also, the temperature of conduit 14, is lowered by the outside air to a level substantially lower than the combustion temperature of the surrounding structure. Further, the particulate matter, such as creosote, remains entrained in the cooled flue gases and does not deposit on the flue wall. Since the flow of outside air is always in the direction of the flue entry opening, entering hot combustion gases are substantially cooled down by about 37%, which in turn reduces corrosion and structural strain of the chimney flue and increases its useful life.

Figure 3:
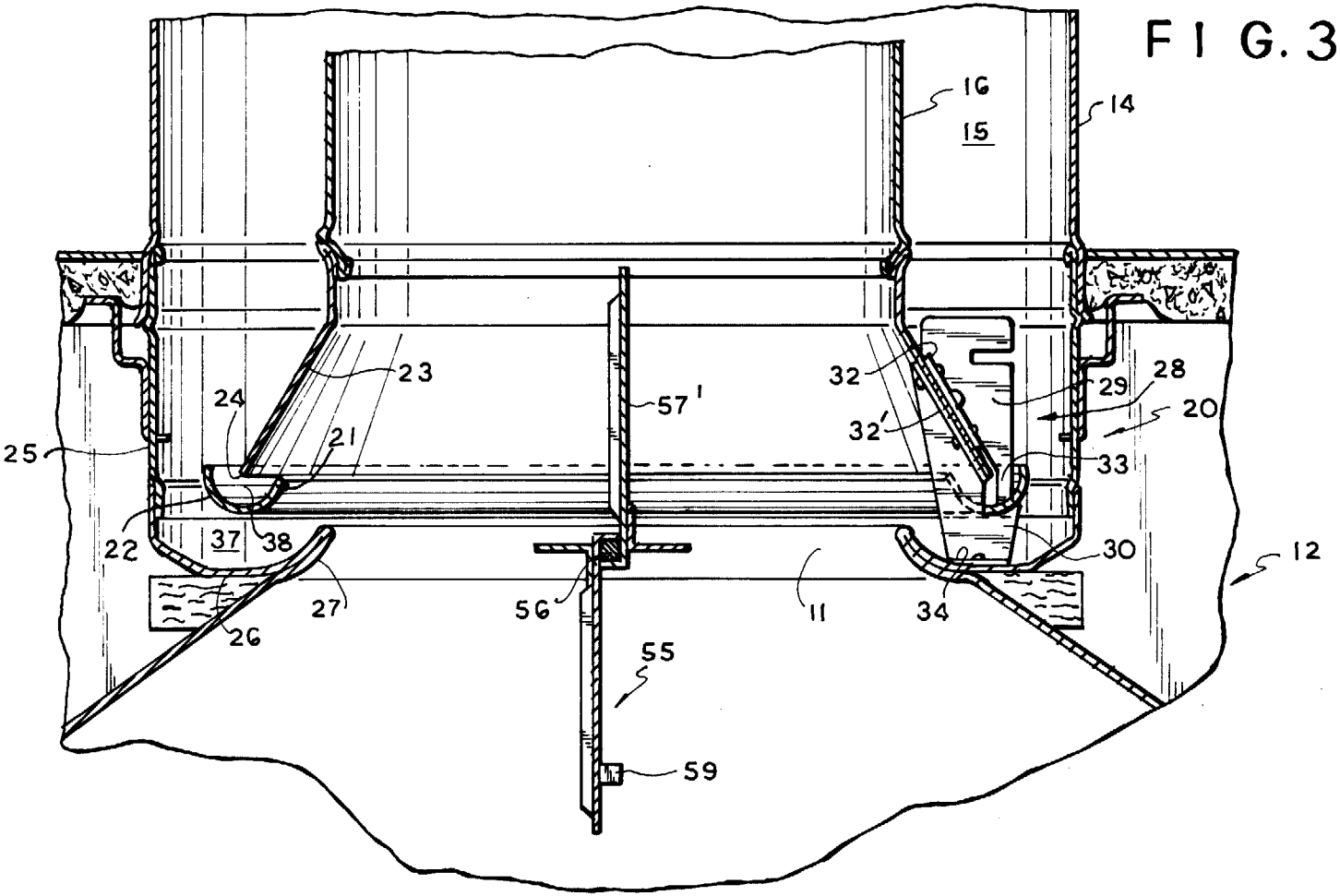
FIG. 3 is a sectional view taken along line 3—3 of FIG. 2.

In FIGS. 2 and 3, a damper assembly 55 of the butterfly type is illustrated and is mounted for rotation on a shaft 56. Damper assembly 55 is in the form of a circular disc 57' and is positioned in combustion gas outlet opening 11 of fireplace 12. Shaft 56 extends through aligned openings 57 in annular collar 25 and extends to a point through the front face of fireplace 12 and terminates in a handle or knob 58. Mounted on circular disc 57 is a weight 59, which maintains damper assembly 55 in a normally open position. When knob 58 is rotated, circular disc 57' rotates and seats against nozzle 27. Should damper assembly 55 malfunction, weight 59 will cause circular disc 57' to rotate on shaft 56 to its normally open position as shown in FIGS. 2 and 3.

Figure 5:
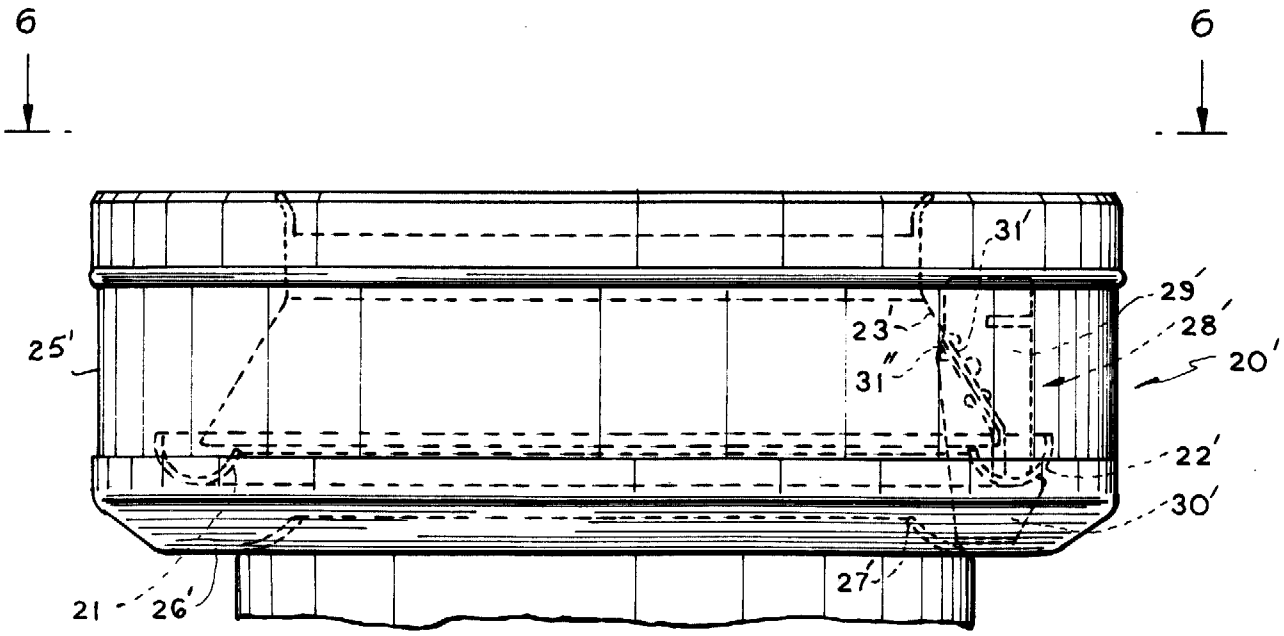
FIG. 5 is an elevational view of the air-turning assembly which is adapted to be mounted to the dual wall chimney of FIG. 1 and flue opening of the fireplace shown in FIG. 2.

FIGS. 5 and 6 illustrate air-turning assembly 20', which is constructed as a separate unit when chimney assembly 10 is made for use without a fireplace as part of the unit. Thus, chimney assembly 10 as illustrated in FIG. 1 includes air-turning assembly 20' as illustrated in FIGS. 5 and 6. The component parts of air-turning assembly 20' are identical to the component parts discussed with respect to FIGS. 1, 2, 3, 4 and 7 and are identified by corresponding primed numerals. Air-turning assembly 20' includes air-turning vane 22', brackets 29', and convergent nozzle 23', all surrounded by annular collar 25'. Annular collar 25' includes a baffle 26' which is turned radially inwardly and terminates in a converging nozzle 27'. When mounted on a dual wall chimney such as illustrated in FIG. 1, the chimney assembly functions as hereinbefore described.

I claim:

1. An outside air-inducing assembly, one end of which is adapted to be coupled to the open lower end of a prefabricated chimney assembly and the other end of which is adapted to be coupled to a source of combustion gases, said chimney assembly including an inner flue and an outer conduit spaced therefrom to define therebetween an annular air passage to conduct only outside air downwardly therethrough, said outside air-inducing assembly comprising:

an annular collar adapted to be coupled at one end thereof to the lower end of said outer conduit and having at the other end thereof an annular baffle extending inwardly;

an air turning vane mounted in spaced relationship with said baffle and said other end of said collar to define a first air passage therebetween;

a convergent nozzle, the larger end of which is positioned within said air-turning vane and spaced therefrom to define a second air passage therebetween, the smaller end of said convergent nozzle being adapted to be coupled to said flue whereby a major portion of outside air flowing downwardly through said annular air passage flows around said air-turning vane through said air passage and a minor portion of said outside air flowing downwardly through said annular air passages through said second air passage between said larger end of said nozzle and said air-turning vane so that all of said outside air is induced into said flue through said convergent nozzle; and

2. The outside-air-inducing assembly of claim 1 wherein bracket means are provided on said annular collar for positioning and mounting said air-turning vane in fixed position.

3. The outside-air-inducing assembly of claim 1 wherein said annular baffle of said annular collar defines a convergent nozzle having an exit cross-sectional area smaller than the cross-sectional area of said flue.

4. A prefabricated chimney assembly having an open upper end and an open lower end adapted to be coupled to a source of combustion gases, said chimney assembly including an inner flue through which combustion gases flow upwardly, said inner flue being spaced from an outer conduit to define therebetween an annular passage to conduct only outside air downwardly therethrough, said chimney assembly further comprising:

a divergent nozzle, the lower end of which is mounted on the open upper end of the flue while the nozzle diverges to a level above the upper end of said outer conduit so that exiting flue gases are discharged to the atmosphere above the outside air entering said annular passage;

an outside air-inducing assembly coupled to said open lower end of said chimney assembly and adapted to be coupled to said source of combustion gases;

said outside air-inducing assembly including an air-turning means, a convergent nozzle and an annular collar enclosing said air-turning means and said convergent nozzle, said annular collar coupled at one end to the lower end of said outer conduit, said annular collar having a baffle at its other end and which extends inwardly at the lower end thereof;

said convergent nozzle, having an upper and smaller end coupled to the lower end of said flue, the larger and lower end of said convergent nozzle being positioned above and in spaced relationship with said baffle; said air-turning means being generally semi-toroidal but the inner rim of said air-turning means includes an extension of a frusto-conical section which directs cooling air upwardly along the inner surface of said convergent nozzle and into said flue adjacent the inner surface thereof; and said air-turning means being mounted in said annular passage of said chimney assembly and positioned in spaced relationship with said baffle and the larger end of said convergent nozzle whereby only outside air flowing downwardly through said annular passage flows into said flue through said convergent nozzle.

5. The prefabricated chimney assembly of claim 4 wherein said air-turning means is mounted above and in spaced relationship with said baffle and said lower end of said chimney assembly to define a first air passage therebetween, and the larger and lower end of said convergent nozzle being positioned within said air-turning means and spaced therefrom to define a second air passage therebetween.

6. An outside air-inducing assembly, one end of which is adapted to be coupled to the open lower end of a prefabricated chimney assembly and the other end of which is adapted to be coupled to a source of combustion gases, said chimney assembly including an inner flue and an outer conduit spaced therefrom to define therebetween an annular air passage to conduct only outside air downwardly therethrough, said outside air-inducing assembly comprising:

an air-turning means, a convergent nozzle and an annular collar enclosing said air-turning means and said convergent nozzle, said annular collar coupled at one end to the lower end of said outer conduit, said annular collar having a baffle at its other end and which extends inwardly at the lower end thereof;

said convergent nozzle, having an upper and smaller end coupled to the lower end of said flue, the larger and lower end of said convergent nozzle being positioned above and in spaced relationship with said baffle;

said air-turning means being generally semi-toroidal but the inner rim of said air-turning means includes an extension of a frusto-conical section which directs cooling air upwardly along the inner surface of said convergent nozzle and into said flue adjacent the inner surface thereof; and said air-turning means being mounted in said annular passage of said chimney assembly and positioned in spaced relationship with said baffle and the larger end of said convergent nozzle whereby only outside air flowing downwardly through said annular passage flows into said flue through said convergent nozzle.

7. The outside air-inducing assembly of claim 6 wherein said air-turning means is mounted above and in spaced relationship with said baffle and said lower end of said chimney assembly to define a first air passage therebetween, and the larger and lower end of said convergent nozzle being positioned within said air-turning means and spaced therefrom to define a second air passage therebetween.

* * * * *